US008009110B2

(12) United States Patent
Teng et al.

(10) Patent No.: US 8,009,110 B2
(45) Date of Patent: Aug. 30, 2011

(54) ELECTRONIC APPARATUS WITH HIDDEN ANTENNA

(75) Inventors: Pei-Ling Teng, Taoyuan County (TW); Kuo-Cheng Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 535 days.

(21) Appl. No.: 12/251,380

(22) Filed: Oct. 14, 2008

(65) Prior Publication Data

US 2009/0167615 A1 Jul. 2, 2009

(30) Foreign Application Priority Data

Dec. 31, 2007 (TW) ..... 96151567 A

(51) Int. Cl.
*H01Q 1/24* (2006.01)

(52) U.S. Cl. ..... 343/702

(58) Field of Classification Search ..... 343/702, 343/700 MS, 767, 846
See application file for complete search history.

(56) References Cited

U.S. PATENT DOCUMENTS

| | | | | |
|---|---|---|---|---|
| 5,808,586 | A * | 9/1998 | Phillips et al. | 343/895 |
| 6,339,400 | B1 * | 1/2002 | Flint et al. | 343/702 |
| 6,950,069 | B2 * | 9/2005 | Gaucher et al. | 343/702 |
| 7,889,139 | B2 * | 2/2011 | Hobson et al. | 343/702 |
| 7,911,387 | B2 * | 3/2011 | Hill et al. | 343/700 MS |
| 2001/0052877 | A1 | 12/2001 | Honda et al. | |
| 2005/0093752 | A1 | 5/2005 | Cheng et al. | |

* cited by examiner

*Primary Examiner* — Huedung Mancuso
(74) *Attorney, Agent, or Firm* — Jianq Chyun IP Office

(57) ABSTRACT

An electronic apparatus with a hidden antenna comprises a metal frame and a substrate. The metal frame comprises a plurality of side walls and a notch is passed through at least one side wall. A feeding terminal is configured at a bottom side of the notch. A first shorting terminal and a second shorting terminal are configured at two lateral sides of the notch. A metal surface of the substrate is electrically connected to the first shorting terminal, the second shorting terminal and the side walls, and the notch is faced to the substrate. The metal frame receives or transmits an electromagnetic signal, and delivers the electromagnetic signal over the feeding terminal, and a length of the bottom side of the notch is one half of a wavelength of the electromagnetic signal.

16 Claims, 8 Drawing Sheets

ELECTRONIC APPARATUS WITH HIDDEN ANTENNA

CROSS-REFERENCE TO RELATED APPLICATION

This application-claims the priority benefit of Taiwan application serial no. 96151567, filed on Dec. 31, 2007. The entirety of the above-mentioned patent application is hereby incorporated by reference herein and made a part of this specification.

BACKGROUND OF THE INVENTION

1. Technology field

The application generally relates to an electronic apparatus with a hidden antenna, and more particularly, to an electronic apparatus including a metal frame of a part of housing for transmitting/receiving electromagnetic signals.

2. Description of Related Art

Currently, wireless communication has become a more popular choice for human beings to communicate with each other. Correspondingly, there have been developed many kinds of wireless communication apparatuses, such as smart cell phones, multimedia players, personal digital assistants (PDAs), and satellite navigators. Almost all of the electronic apparatus capable of wireless transmittance are developed with a concept toward light weight and slimness, so as to become more welcome to the consumers.

Generally, antennas are critical components for electronic apparatus to receive or transmit signals. Typically, most electronic apparatuses equip with monopole antennas or a planar inverted F antenna to achieve a micro antenna or a hidden antenna. The reason for doing so is that fundamental modes of both of these two kinds of antennas resonate at a ¼ wavelength, so as to be capable of diminishing sizes thereof.

Alternatively, loop antennas are also adopted by some electronic apparatuses. Conventional loop antennas have some certain advantages. For example, a balance-fed type loop antenna can advantageously reduce an excitation current on the metal surface, so that the antenna would be less affected by the environment and the metal surface. Alternatively, the loop antennas may be multiple bent so as to reduce the space occupation thereof for being applied in the small size electronic apparatuses. Principle of application of the loop antenna is to be illustrated below, and whether the mode of the loop antenna could be excited is also discussed below from a point of view whether the energy can be transmitted.

FIG. 1 is a schematic diagram illustrating a current distribution of a loop antenna at a full wavelength mode. Referring to FIG. 1, the loop antenna 110 utilizes a coaxial cable 120 having a resistance of 50Ω as a path for signal transmittance. As shown in FIG. 1, directed by the arrow symbols, along a direction of a current flowing through the loop antenna 110, there exist two current zero points, Z1 and Z2. A current flowing through an internal conductor 121 of the coaxial cable 120 flows out the coaxial cable 120. A current flowing through an external conductor 122 of the coaxial cable 120 flows in the coaxial cable 120. In other words, currents flowing through the internal conductor and the external conductor of the coaxial cable 120 flow along directions opposite one to another. The opposite directions of the currents meet the rule of transmission line for transmitting energy, and therefore the coaxial cable 120 is capable of transmitting energy to the loop antenna 110, and thus exciting a full wavelength resonance mode.

FIG. 2 is a schematic diagram illustrating a current distribution of a loop antenna at a half wavelength mode. Referring to FIG. 2, the loop antenna 210 utilizes a coaxial cable 220 having a resistance of 50Ω as a path for signal transmittance. As shown in FIG. 2, as indicated by the arrows showing a direction of a current flowing through the loop antenna 210, there exists only one current zero point Z21. A current flowing through an external conductor 221 of the coaxial cable 220 flows out of the coaxial cable 220. A current flowing through an external conductor 222 of the coaxial cable 120 also flows out the coaxial cable 120. In other words, currents flowing through the internal conductor 221 and the external conductor 222 of the coaxial cable 120 flow along the same direction. The same current direction violates the rule of transmission line for transmitting energy, and therefore the coaxial cable 220 is incapable of transmitting energy to the loop antenna 210, and thus cannot excite a half wavelength resonance mode.

In summary, a loop antenna is typically operated at a full wavelength resonance mode. In such a way, the loop antenna is likely to achieve an impedance matching of 50Ω and obtain better radiation efficiency. However, because the loop antenna adopts a full wavelength mode for operation, it would occupy a larger space within the electronic apparatus, and thus restricting the miniaturization of the electronic apparatus.

SUMMARY OF THE INVENTION

Accordingly, the application is directed to an electronic apparatus with a hidden antenna. The electronic apparatus includes a metal frame reinforcing the structure of the electronic apparatus. The metal frame is adapted for receiving/transmitting an electromagnetic signal. Therefore, the need for a hardware space occupied by the antenna may be eliminated and the overall fabrication cost may be reduced.

The application is also directed to an electronic apparatus with a hidden antenna. The electronic apparatus utilizes a metal frame of a part of a housing of the electronic apparatus for receiving/transmitting an electromagnetic signal, and thus possible to realize miniaturization of the electronic apparatus.

The application provides an electronic apparatus with a hidden antenna. The electronic apparatus includes a metal frame, a substrate, an upper housing, and a lower housing. The metal frame includes a plurality of side walls. The metal frame is engaged with the upper housing, and the metal frame is engaged with the lower housing. Therefore, the metal frame, the upper housing, and the lower housing form a cavity for accommodating the substrate.

Furthermore, the substrate includes a metal surface. At least one side wall has a notch, where the notch passes through at least one side wall of the metal frame. There is a feeding terminal configured at a bottom side of the notch. A first shorting terminal and a second shorting terminal are configured at two lateral sides of the notch. The metal surface of the substrate is electrically connected to the first shorting terminal, the second shorting terminal and the side walls of the metal frame, and the notch is faced to the substrate.

In general, a half wavelength loop antenna is configured by the metal frame with the first shorting terminal, the second shorting terminal, and a feeding terminal. As such, the electronic apparatus can utilize the frame for receiving/transmitting the electromagnetic signal, and delivering the electromagnetic signal over the feeding terminal. Furthermore, according to an aspect of the embodiment, a length of the bottom side of the notch is one half of a wavelength of the electromagnetic signals.

According to an embodiment of the present invention, the notch is passed through two adjacent side walls.

The application provides an electronic apparatus with a hidden antenna. The electronic apparatus includes a metal frame, an upper housing and a lower housing. The metal frame includes a plurality of side walls. The upper housing is engaged with the metal frame. The lower housing is engaged with the metal frame. Therefore, the metal frame, the upper housing, and the lower housing configure an entire housing to reinforce the stiffness of the electronic apparatus.

Furthermore, the metal frame has a notch, wherein the notch passes through at least one side wall. There is a feeding terminal configured at a bottom side of the notch. An internal wall of the lower housing includes a metal surface configured thereby. A first shorting terminal and a second shorting terminal are configured at two lateral sides of the notch. The metal surface of the lower housing is electrically connected to the first shorting terminal, the second shorting terminal and the side walls of the metal frame, and the notch is faced to the substrate.

In general, a half wavelength loop antenna is configured by the electronic apparatus with the first shorting terminal, the second shorting terminal, and a feeding terminal. As such, the electronic apparatus can utilize the frame for receiving/transmitting the electromagnetic signal, and delivering the electromagnetic signal via the feeding terminal. According to an aspect of the embodiment, length of the bottom side of the notch is one half of a wavelength of the electromagnetic signal.

The application employs a metal frame for reinforcing the structure of the electronic apparatus. The metal frame is employed for receiving/transmitting electromagnetic signals. Therefore, compared to the conventional art, the application proposes a scheme of eliminating a need for a space for accommodating an antenna so that further miniaturization of the electronic apparatus may be realized and also reduce the overall fabrication cost for the electronic apparatus.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
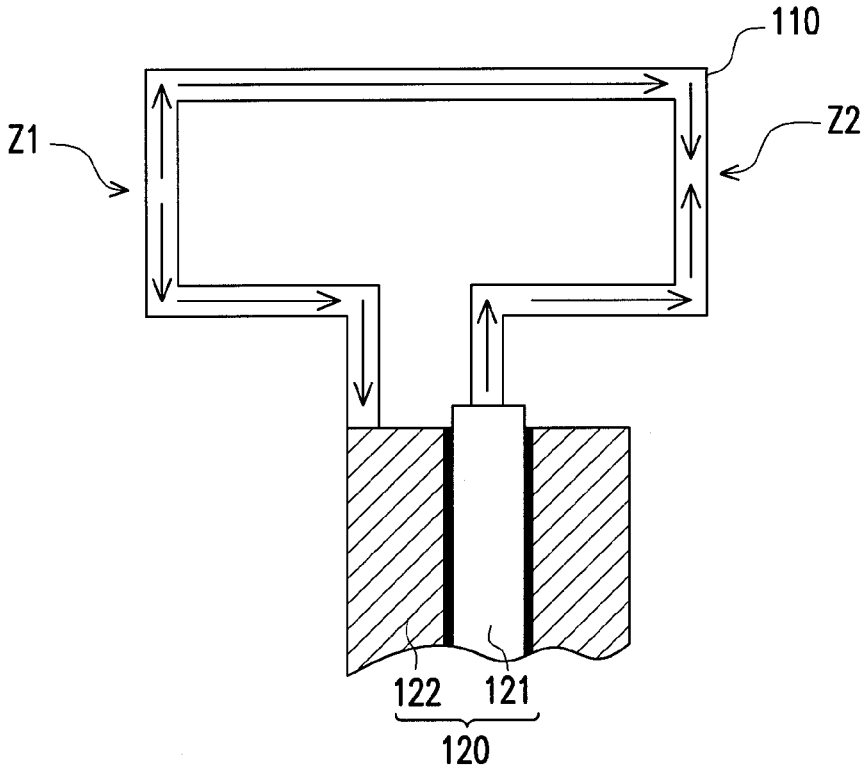
FIG. 1 (PRIOR ART)
FIG. 1 is a schematic diagram illustrating a current distribution of a loop antenna at a full wavelength mode.
Figure 2:
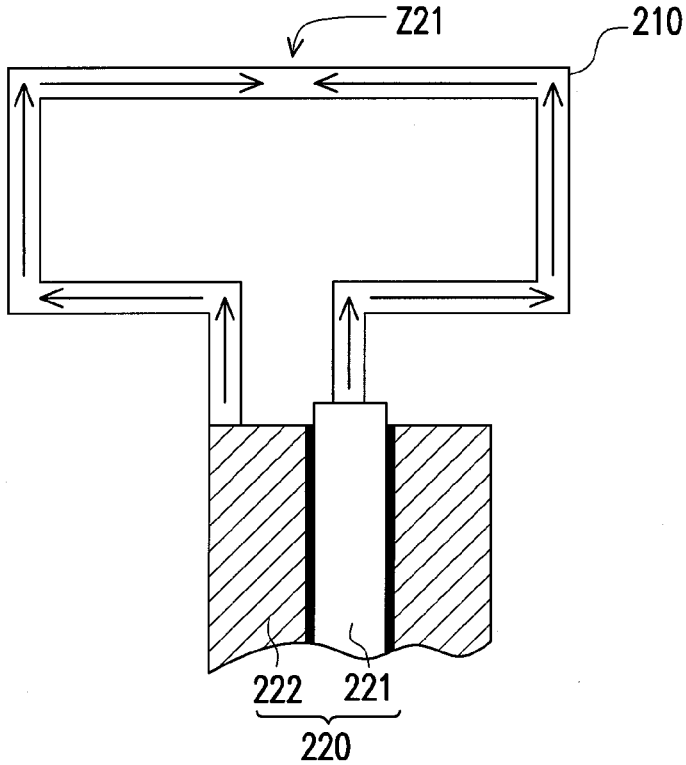
FIG. 2 (PRIOR ART)
FIG. 2 is a schematic diagram illustrating a current distribution of a loop antenna at a half wavelength mode.

Reference will now be made in detail to the present preferred embodiments of the invention, examples of which are illustrated in the accompanying drawings. Wherever possible, the same reference numbers are used in the drawings and the description to refer to the same or like parts.

The application is featured in that a metal frame is employed for reinforcing the structure of an electronic apparatus. The metal frame is adapted for receiving and transmitting an electromagnetic signal. The electronic apparatus with a hidden antenna is illustrated hereafter without restricting the electronic apparatus of being PDA cell phone, smart phones or a satellite navigator.

Figure 3A:
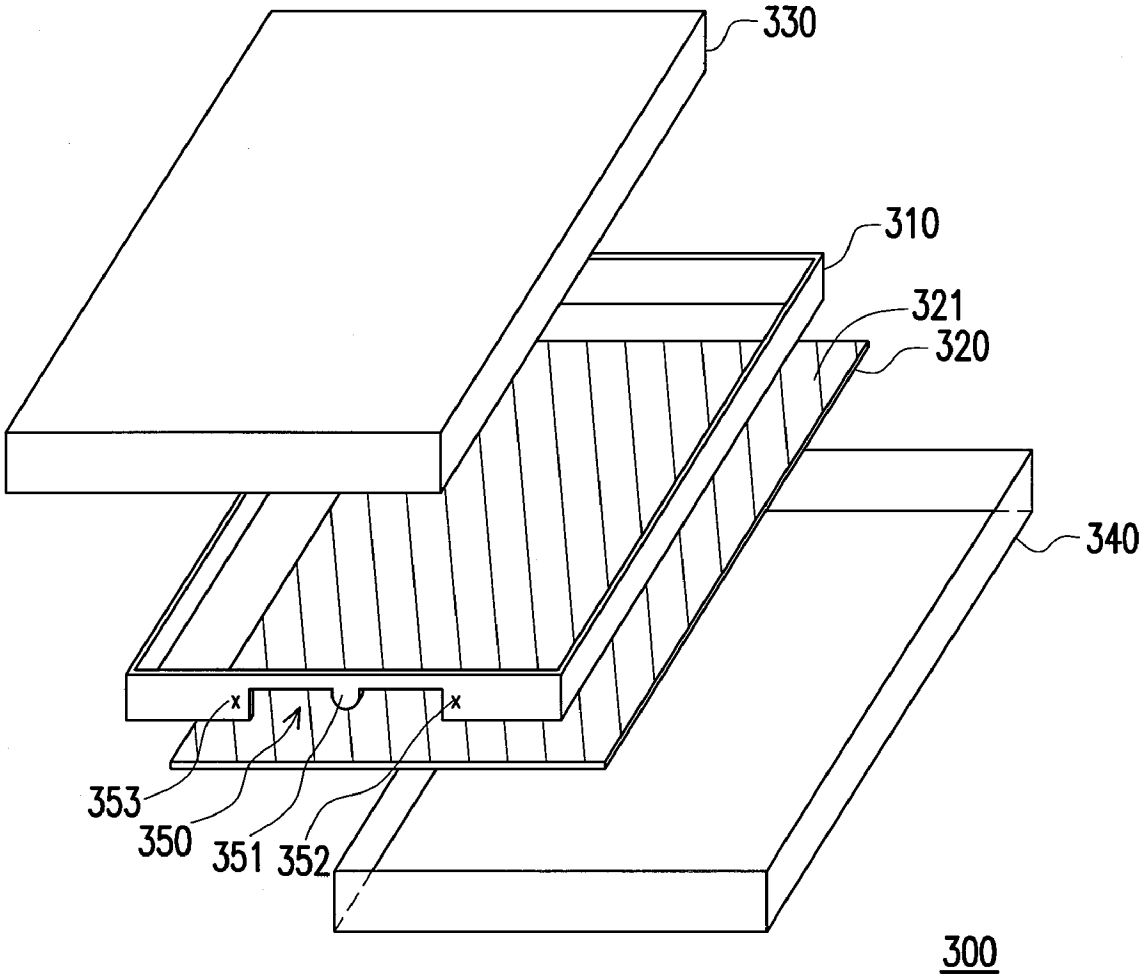
FIG. 3A is a schematic diagram illustrating a theory according to an embodiment of the present invention.

FIG. 3A is a schematic structural diagram illustrating a theory with a hidden antenna according to an embodiment of the present invention. Referring to FIG. 3A, the electronic apparatus 300 includes a metal frame 310, a substrate 320 and a metal lower housing 340. The substrate includes a metal surface 321. The metal frame 310 includes an upper surface edge, a lower surface edge and a plurality of side walls. The metal frame 310 is made of a metal material including aluminum, steel, stainless steel, iron, copper, phosphor bronze or beryllium copper, and any combination these metals.

The lateral sides of the metal frame 310 are electrically connected to the metal surface 321 of the substrate 320. The upper housing 330 is engaged with the upper surface edge of the metal frame 310. The lower housing 340 is engaged with the lower surface edge of the metal frame 310. Therefore, the upper housing 330, the metal frame 310 and the lower housing 340 form a cavity for accommodating the substrate 320, and thereby reinforcing the structure of the electronic apparatus 300.

It should be noted that one skilled in the art may use an manufacturing technology to form the metal frame 310 which is integrally formed with the upper housing 330 or the lower housing 340. This may contribute to further improve the structure of the electronic apparatus 300. According to an aspect of the embodiment, the substrate 320 is a metal backplate of a display panel or a printed circuit board (PCB).

Again referring to FIG. 3A, a notch 350 is configured at the metal frame 310. According to an aspect of the embodiment, the notch 350 passes through at least one side wall of the metal frame 310, so as to configure a first shorting terminal 352 and a second shorting terminal 353 at two lateral sides of the notch 350. There is a feeding terminal 351 configured at a bottom side of the notch 350. The notch 350 faces to the substrate 320. The side walls, the first shorting terminal 352 and the second shorting terminal 353 are electrically connected to metal surface 321 of the substrate 320.

In general, the metal frame 310 serves as a loop antenna of the electronic apparatus 300 for receiving and transmitting electromagnetic signals. The loop antenna is substantially composed of the feeding terminal 351, the first shorting terminal 352, and the second shorting terminal 353. A principle of operation of the loop antenna is illustrated below with reference to FIG. 3B.

Figure 3B:
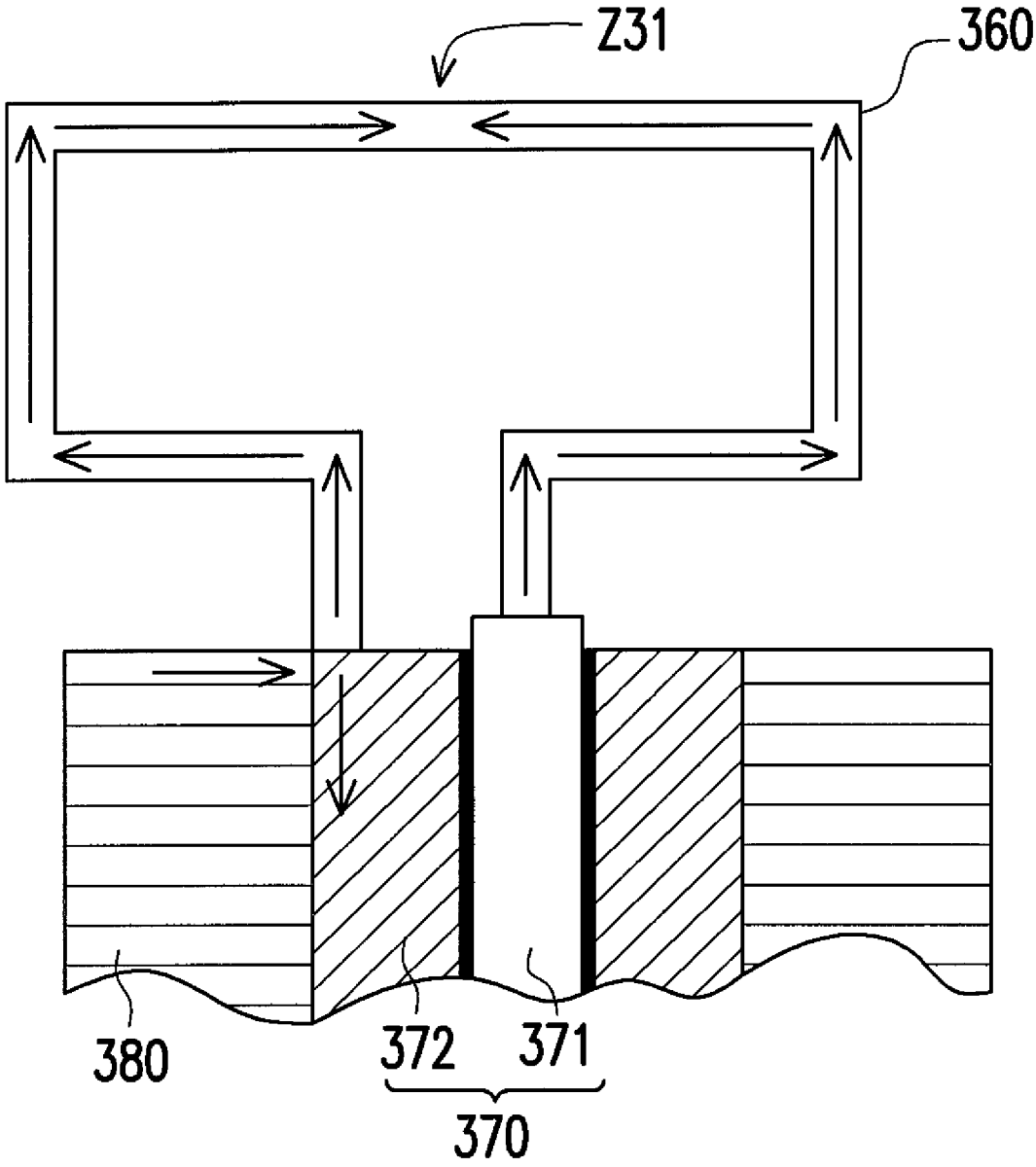
FIG. 3B is a schematic structural diagram illustrating an electronic apparatus with a hidden antenna according to an embodiment of the present invention.

FIG. 3B is a schematic structural diagram illustrating an electronic apparatus with a hidden antenna according to an embodiment of the present invention. Referring to FIG. 3B, a loop antenna 360 utilizes a coaxial cable 370 having a resistance of 50Ω as a path for signal transmittance. The coaxial cable 370 is electrically connected to the metal surface 380.

As shown by the arrows in FIG. 3B, which indicates the direction of a current flowing through the loop antenna 360 and a current zero point Z31. Currents at two sides of the current zero point Z31 flow in opposite directions. A current flowing through an internal conductor 371 of the coaxial cable 370 flows out the coaxial cable 370.

As to an external conductor 372 of the coaxial cable 370, a negative current of the loop antenna 360 is provided by an excitation current of the metal surface 380 flowing out the coaxial cable 370. In such a way, currents flowing through the internal conductor 371 and the external conductor 372 of the coaxial cable 370 flow along directions opposite one to another. In other words, when the loop antenna 360 is electrically connected to the metal surface 380, the coaxial cable 370 is capable of transmitting energy to the loop antenna 360, and thus exciting a half wavelength resonance mode.

As discussed above, it can be learnt that when the first shorting terminal 352 and the second shorting terminal 353 are electrically connected to the metal surface 321 of the substrate 320, the metal frame 310 serves as a half wavelength loop antenna, and is adapted to deliver electromagnetic signals received or transmitted thereby via the feeding terminal 351. In order to achieve such a half wavelength loop antenna and according to an aspect of the embodiment, a length of the notch 350 is one half of a wavelength of the electromagnetic signals. Those skilled in the art may be taught by the disclosure to modify the frequency band of the electromagnetic signals received or transmitted by the metal frame 310 by varying a distance between the feeding terminal 351 and the first shorting terminal 352.

On the other hand, a path from the feeding terminal 351 to the first shorting terminal 352 is a main excitation path of the metal frame 310. Those skilled in the art may alternatively adjust the relative positions of the feeding terminal to the second shorting terminal 353, so as to modify an impedance matching of the metal frame. According to an aspect of the application, the feeding terminal 351 is disposed at a center place of the bottom side of the notch 350, so as to allow the metal frame 310 to receive or transmit electromagnetic signals having a wider frequency bandwidth. According to an aspect of the embodiment, a depth of the notch 350 is 1 mm. According to another aspect of the embodiment, the notch 350 is disposed at a lower edge of the electronic apparatus 300 for a handheld effect or a human body effect applied to the metal frame 310.

It should be noted that the metal frame 310 not only reinforces the structure of the electronic apparatus 300, but also configures a loop antenna provided to the electronic apparatus 300 for receiving/transmitting electromagnetic signals. As discussed above, the loop antenna configured by the metal frame 310 is adapted for operating at a half wavelength resonance mode. As such, the electronic apparatus 300, compared to the conventional technology, can be further miniaturized, and also the fabrication cost may be reduced and the structure of the electronic apparatus may be reinforced.

Figure 4:
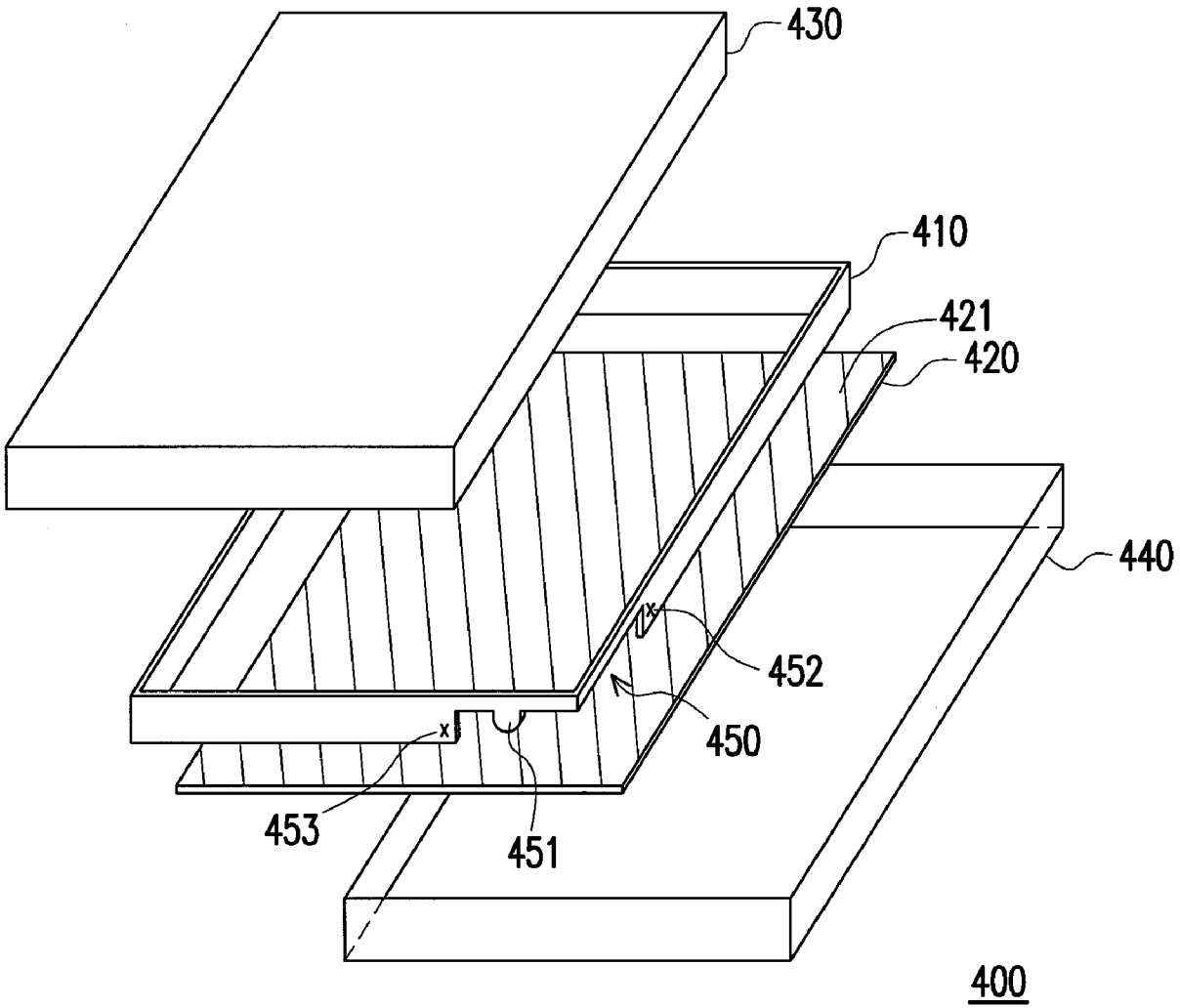
FIG. 4 is a schematic structural diagram illustrating an electronic apparatus with a hidden antenna according to another embodiment of the present invention.

FIG. 4 is a schematic structural diagram illustrating an electronic apparatus with a hidden antenna according to another embodiment of the present invention. Referring to FIG. 4, there is shown an electronic apparatus 400. The electronic apparatus 400 includes a metal frame 410, a substrate 420, an upper housing 430 and a lower housing 440. The substrate 420 includes a metal surface 421. The metal frame has an upper surface edge, a lower surface edge and a plurality of side walls.

The arrangement and principle of operation of the current embodiment are similar to that shown in FIG. 3. According to the present embodiment, the upper housing 430, the metal frame 410, and the lower housing 440 form a cavity for accommodating the substrate 420, and reinforcing the structure of the electronic apparatus 400. A notch 450 is configured at the metal frame 410. The notch 450 passes through at least one side wall of the metal frame 410 so as to configure a first shorting terminal 452 and a second shorting terminal 453 at two lateral sides of the notch 450. The first shorting terminal 452 and the second shorting terminal 453 are electrically connected to metal surface 421 of the substrate 420. In such a way, the electronic apparatus 400 is adapted for receiving/transmitting electromagnetic signals over the metal frame 410, and delivering the electromagnetic signals by a feeding terminal 451 configured at a bottom side of the notch 450. In other words, the metal frame according to an embodiment of the preset invention not only reinforces the structure of the electronic apparatus 400, but also serves as a loop antenna provided for the electronic apparatus 400 for receiving/transmitting electromagnetic signals.

The present embodiment differs from the embodiment described with reference to FIG. 3 in that the notch 450 is located at a corner formed by a connection part between two adjacent side walls of the metal frame 410, and the notch 450 passes through the two adjacent side walls. In other words, the notch 450 passes through two adjacent side walls. The notch 450 faces to the substrate 320. Further, a path from the feeding terminal 451 to the first shorting terminal 452 is a main excitation path of the metal frame 410, and an impedance matching of the metal frame 410 can be determined according to a distance from the feeding terminal 451 to the second shorting terminal 453. Other details about this embodiment can be learnt by referring to the foregoing embodiment of FIG. 3, and is not iterated hereby. Below, simulated and practical measurement diagrams are given according to the embodiments of the present invention.

Figure 5A:
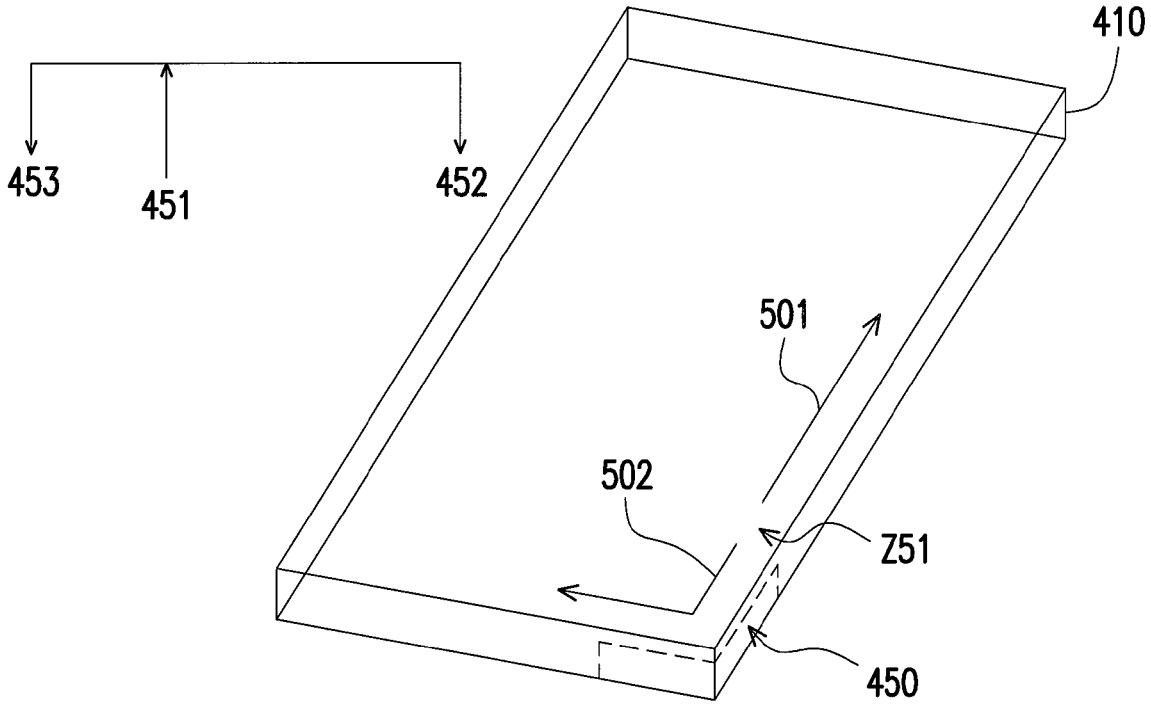
FIG. 5A is a schematic diagram illustrating a current distribution when the metal frame 410 resonates at a 2.45 GHz.

FIG. 5A is a schematic diagram illustrating a current distribution when the metal frame 410 resonates at a 2.45 GHz. As shown in FIG. 5A, the feeding terminal 451, the first shorting terminal 452, and the second shorting terminal 453 are disposed in similar positions of the metal frame 410 as shown in FIG. 4. Arrows 501, 502 are used for indicating a current flowing direction along which the current flows in the metal frame 410 when the metal frame 410 is excited. It can be learnt from FIG. 5A, the current zero point Z51 is located between the arrows 501 and 502, and therefore the metal frame 410 is a half wavelength resonance antenna. Furthermore, current flowing through the metal frame 410 is mainly distributed at a peripheral areas of the notch 450. As such, a part of metal frame 410 surrounding the notch 450 is a main radiation region for receiving/transmitting electromagnetic signals. Correspondingly, the remaining parts of metal frame 410 and the metal surface 421 having only a small amount of current flowing therethrough are attributed as non-radiation regions of the metal frame 410. Current distributed in the non-radiation regions is constantly smaller than that distributed in the radiation region. Therefore, the metal frame 410 is not likely to be affected by ambient environment.

Figure 5B:
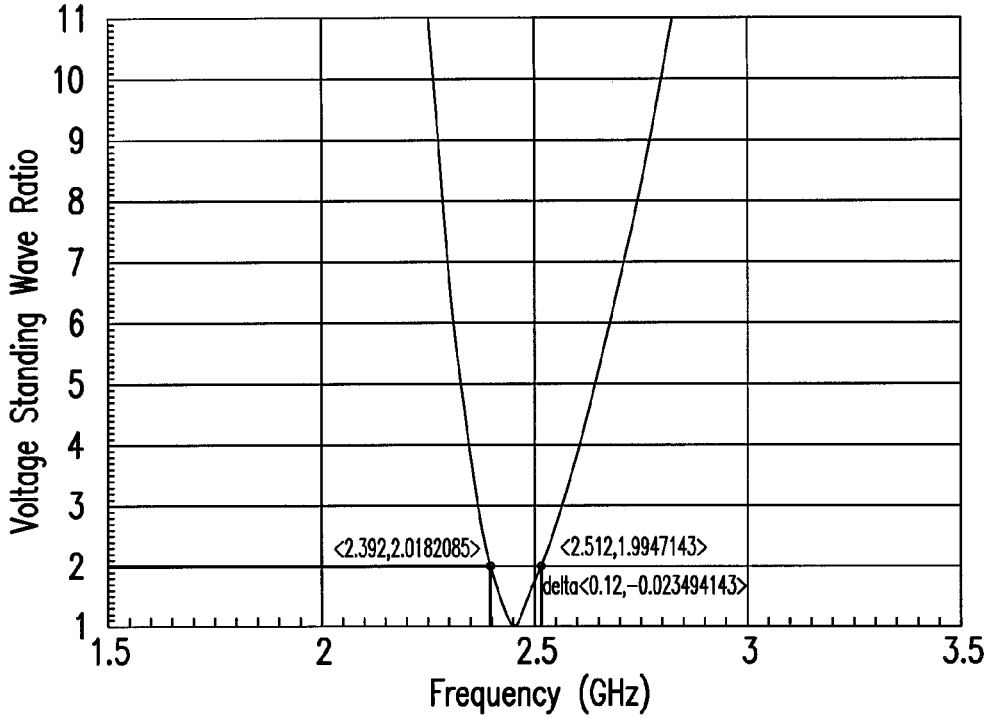
FIG. 5B is a schematic diagram simulating a voltage standing wave ratio when the metal frame 410 resonates at a 2.45 GHz.
Figure 5C:
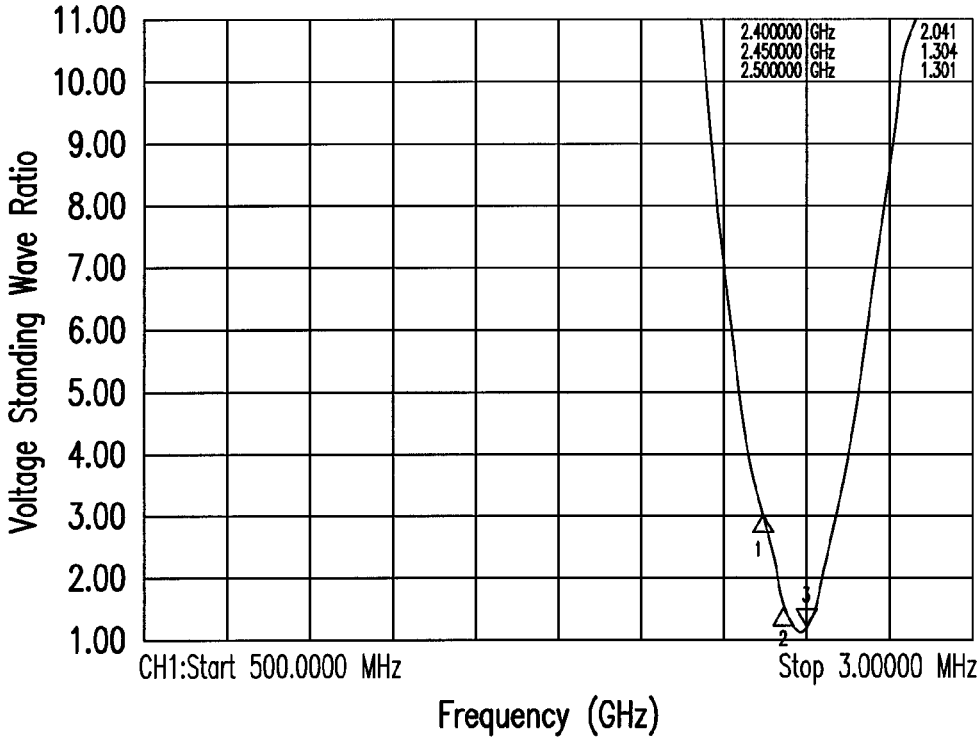
FIG. 5C is a schematic diagram illustrating a practical measured voltage standing wave ratio when the metal frame 410 resonates at a 2.45 GHz.
Figure 5D:
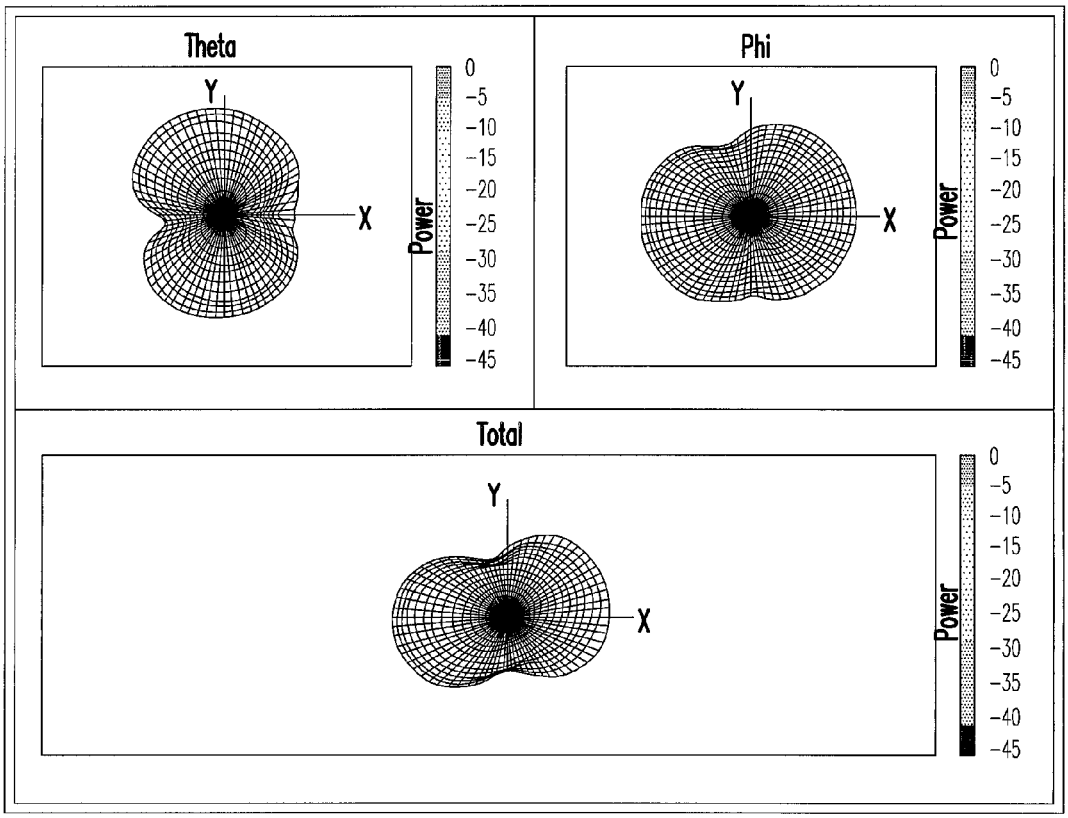
FIG. 5D is a practical measurement diagram illustrating a 3D pattern when the metal frame 410 resonates at a 2.45 GHz.

FIG. 5B is a schematic diagram simulating a voltage standing wave ratio when the metal frame 410 resonates at a 2.45 GHz. Referring to FIG. 5B, when a voltage standing wave ratio is smaller than 2, a range of the frequency bandwidth of the metal frame 410 is between 2.392 GHz and 2.512 GHz. The frequency bandwidth is 120 MHz. FIG. 5C is a schematic diagram illustrating a practical measured voltage standing wave ratio when the metal frame 410 resonates at a 2.45 GHz. Referring to FIG. 5C, according to the practical measurement, a center frequency of the metal frame 410 is also 2.45 GHz. Therefore, it can be concluded that the simulation well correlates with the practical measurement. FIG. 5D is a practical measurement diagram illustrating a 3D pattern when the metal frame 410 resonates at a 2.45 GHz. Referring to FIG. 5D, the radiation characteristic of the metal frame 410 is similar to that of a half wavelength dipole antenna. This evidences that the present embodiment of the present invention is a half wavelength resonance mode loop antenna, rather than a full wavelength resonance mode loop antenna.

Figure 6:
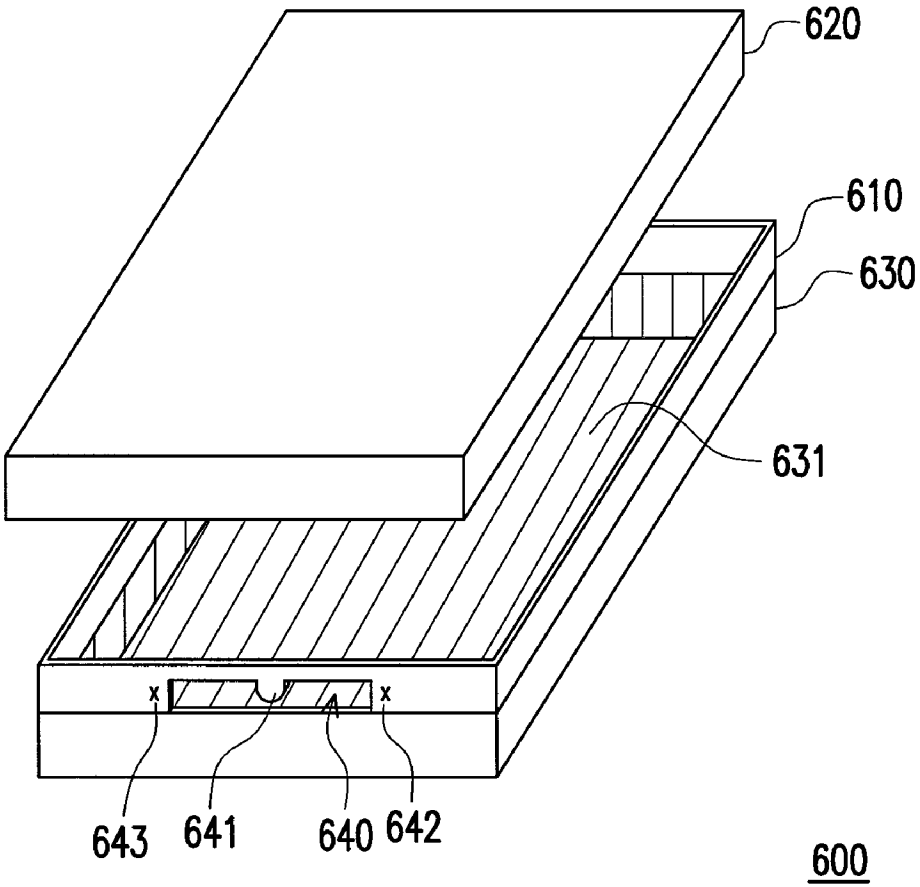
FIG. 6 is a schematic structural diagram illustrating an electronic apparatus with a hidden antenna according to a still further embodiment of the present invention.

FIG. 6 is a schematic structural diagram illustrating an electronic apparatus with a hidden antenna according to a still another embodiment of the present invention. Referring to FIG. 6, there is shown an electronic apparatus 600 including a metal frame 610, an upper housing 620, and a lower housing 630. The lower housing 630 includes a metal surface 631 covering an internal wall of the lower housing 630. The metal frame 630 includes an upper surface edge, a lower surface edge, and a plurality of side walls. The metal frame can be fabricated by metal materials including aluminum, steel, stainless steel, iron, copper, phosphor bronze, and beryllium copper.

The side walls of the metal frame 610 are electrically connected to the metal surface 631. The upper housing 620 is engaged with the upper surface edge of the metal frame 610. The lower housing 630 is engaged with the lower surface edge of the metal frame 610. Therefore, the upper housing 620, the metal frame 610, and the lower housing 630 in conjunction form a cavity for accommodating the substrate 620, and reinforcing the structure of the electronic apparatus. It should be noted that one skilled in the art may use a manufacturing technology to form the metal frame 610 which is integrally formed with the lower housing 630. This may contribute to further improve the structure of the electronic apparatus 600.

Further, a notch 640 is configured at the metal frame 610. According to an aspect of the embodiment, the notch 640 passes through a side wall of the metal frame 610, so as to configure a first shorting terminal 642 and a second shorting terminal 643 at two lateral sides of the notch 640. There is a feeding terminal 641 configured at a bottom side of the notch 640. The first shorting terminal 642 and the second shorting terminal 643 are electrically connected to metal surface 631.

In general, the metal frame 610 serves as both a structural enforcement of electronic apparatus 600 and a loop antenna of the electronic apparatus 600 for receiving/transmitting electromagnetic signals. The loop antenna is substantially composed of the feeding terminal 641, the first shorting terminal 642 and the second shorting terminal 643 of the metal frame 610. The metal frame 610 is being operated with a half wavelength excitation status. Therefore, a length of the bottom side of the notch is one half of a wavelength of the electromagnetic signal. Those skilled in the art may be taught by the disclosure to modify the frequency band of the electromagnetic signals received or transmitted by the metal frame 610 by varying a distance between the feeding terminal 641 and the first shorting terminal 642.

On the other hand, a path from the feeding terminal 641 to the first shorting terminal 642 is a main excitation path of the metal frame 610. A distance from the feeding terminal 641 to the second shorting terminal 643 is used for determining an impedance matching of the metal frame 610. According to an aspect of the present invention, the feeding terminal 641 is disposed at a center place of the bottom side of the notch 640, so as to allow the metal frame 610 to receive or transmit electromagnetic signals having a wider frequency bandwidth. According to an aspect of the embodiment, a depth of the notch 640 is 1 mm. According to another aspect of the embodiment, the notch 640 is disposed at a lower edge of the electronic apparatus 600 for a handheld effect or a human body effect applied to the metal frame 610.

In summary, the application employs a metal frame for improving the stiffness of the electronic apparatus. The metal frame is further adapted for receiving/transmitting electromagnetic signals. Therefore, compared to the conventional technologies, the application is adapted for reducing the space occupied by the antenna for realizing further miniaturization and strengthening the structure of the electronic apparatus and also reducing the fabrication cost.

It will be apparent to those skilled in the art that various modifications and variations can be made to the structure of the application without departing from the scope or spirit of the invention. In view of the foregoing, it is intended that the application cover modifications and variations of this application provided they fall within the scope of the following claims and their equivalents.

What is claimed is:

1. An electronic apparatus with a hidden antenna, comprising:

a metal frame, comprising a plurality of side walls, wherein a notch is passed through at least one side wall, a first shorting terminal and a second shorting terminal are configured at two lateral sides of the notch, and a feeding terminal is configured at a bottom side of the notch; and a substrate, comprising a metal surface, electrically connected to the first shorting terminal, the second shorting terminal and the side walls, and the notch is faced to the substrate, wherein the metal frame receives or transmits an electromagnetic signal, and delivers the electromagnetic signal over the feeding terminal, and a length of the bottom side of the notch is one half of a wavelength of the electromagnetic signal.

2. The electronic apparatus according to claim 1, further comprising:

an upper housing engaged with the metal frame; and a lower housing engaged with the metal frame, wherein the upper housing, the lower housing and the metal frame form a cavity for accommodating the substrate.

3. The electronic apparatus according to claim 2, wherein the metal frame and the upper housing are integrally formed.

4. The electronic apparatus according to claim 2, wherein the metal frame and the lower housing are integrally formed.

5. The electronic apparatus according to claim 1, wherein the notch is passed through two adjacent side walls.

6. The electronic apparatus according to claim 1, wherein a depth of the notch is 1 mm.

7. The electronic apparatus according to claim 1, wherein the feeding terminal is disposed at a center place of the bottom side of the notch.

8. The electronic apparatus according to claim 1, wherein the substrate is a metal backplate of a display panel.

9. The electronic apparatus according to claim 1, wherein the substrate is a printed circuit board.

10. The electronic apparatus according to claim 1, wherein the electronic apparatus includes a personal digital assistant cell phone, a smart cell phone, a satellite navigator or a personal digital assistant.

11. An electronic apparatus with a hidden antenna, comprising:

a metal frame, comprising a plurality of side walls, wherein a notch is passed through at least one side wall, a first shorting terminal and a second shorting terminal are configured at two lateral sides of the notch and a feeding terminal is configured at a bottom side of the notch;

an upper housing engaged with the metal frame; and a lower housing engaged with the metal frame, wherein a metal surface is configured on an internal wall of the lower housing, the metal surface is electrically connected to the first shorting terminal, the second shorting terminal, and the side walls, and wherein the metal frame receives or transmits an electromagnetic signal, and delivers the electromagnetic signal over the feeding terminal, and a length of the bottom side of the notch is one half of a wavelength of the electromagnetic signal.

12. The electronic apparatus according to claim 11, wherein the notch is passed through two adjacent side walls.

13. The electronic apparatus according to claim 11, wherein the metal frame and the lower housing are integrally formed.

14. The electronic apparatus according to claim 11, wherein the feeding terminal is disposed at a center place of the bottom side of the notch.

15. The electronic apparatus according to claim 11, wherein a depth of the notch is 1 mm.

16. The electronic apparatus according to claim 11, wherein the electronic apparatus includes a personal digital assistant cell phone, a smart cell phone, a satellite navigator or a personal digital assistant.

* * * * *